US006543366B2

(12) United States Patent
Pabst et al.

(10) Patent No.: US 6,543,366 B2
(45) Date of Patent: Apr. 8, 2003

(54) CONTINUOUSLY MOVING CABLE TRACTION HAULAGE SYSTEM WITH VEHICLES EQUIPPED WITH DISENGAGEABLE COUPLING CLAMPS

(75) Inventors: Otto Pabst, Rio Pusteria (IT); Andreas Mair, Prati/Val di Vizze (IT)

(73) Assignee: High Technology Investments BV (NL)

( * ) Notice: Subject to any disclaimer, the term of this patent is extended or adjusted under 35 U.S.C. 154(b) by 0 days.

(21) Appl. No.: 09/994,341

(22) Filed: Nov. 26, 2001

(65) Prior Publication Data

US 2002/0134276 A1 Sep. 26, 2002

(30) Foreign Application Priority Data

Nov. 27, 2000 (IT) ..... BZ00A0050

(51) Int. Cl.[7] ..... B61B 12/12

(52) U.S. Cl. ..... 104/202; 104/87; 104/204; 104/173.2

(58) Field of Search ..... 104/87, 112, 193, 104/202, 206, 209, 215, 216, 229, 232, 211, 212, 173.2

(56) References Cited

U.S. PATENT DOCUMENTS

| | | | | | |
|---|---|---|---|---|---|
| 3,850,110 | A | * | 11/1974 | Berry et al. | 104/173.2 |
| 3,871,304 | A | * | 3/1975 | Dettoni | 104/178 |
| 4,641,585 | A | * | 2/1987 | Tarassoff | 104/173.2 |
| 4,860,664 | A | * | 8/1989 | Kunczynski | 104/204 |
| 4,957,047 | A | * | 9/1990 | Feuz et al. | 104/204 |
| 6,321,658 | B1 | * | 11/2001 | Pabst et al. | 104/202 |

* cited by examiner

*Primary Examiner*—S. Joseph Morano
*Assistant Examiner*—Frantz F. Jules
(74) *Attorney, Agent, or Firm*—Shlesinger, Fitzsimmons & Shlesinger

(57) ABSTRACT

A continuously moving cable traction haulage system with vehicles equipped with coupling clamps disengageable from the cable comprising in the stations an uncoupling rail and one for coupling the clamp to the rail is described. In accordance with the present invention the coupling rail (1) is supported in a sprung manner and therewith is associated a sprung roller (23) bearing the traction cable (7) between two fixed guide rollers.

8 Claims, 5 Drawing Sheets

CONTINUOUSLY MOVING CABLE TRACTION HAULAGE SYSTEM WITH VEHICLES EQUIPPED WITH DISENGAGEABLE COUPLING CLAMPS

FIELD OF THE INVENTION

The present invention relates to a continuously moving cable traction haulage system with vehicles equipped with desengageable coupling clamps in accordance with the charcterizing part of claim 1.

BACKGROUND OF THE INVENTION

In known systems of this type the transportation vehicles are connectable to a continuously moving haulage cable so that they can be moved for example along rails. In the stations of course the vehicles must be disengaged from the cable to allow alighting and boarding of the persons to be transported. In addition, to stop the disengaged vehicle in the stations there must be provided appropriate braking means and to bring the vehicles to the speed of the haulage cable they must be accelerated by acceleration means to again couple the vehicles to the cable moving at constant speed.

To couple the clamps, which are integral with the transportation vehicles, rails designed to act on operating levers of a jaw loaded elastically by a spring are provided at the station entrance just as at the outlet of the station there must be provided a rail designed to close the movable clamp by means of a lever whose end engages for example by means of a wheel on the active surface of the coupling rail. The coupling rail must of course display a rise to be able to cause the movable jaw to clamp around a dead axle while clasping the cable and the rise, i.e the fullest opening of the clamp must be located along the cable at a point where the vehicles have reached a speed equal to that of the continuously moving cable.

In known systems the haulage cable is guided around freely turning rollers fixed along the system path which thus hold the cable in a certain position especially to allow guidance without bumps along the rails. The problem of varying weight of the vehicles in the stations now appears due to different numbers of passengers because the vehicle lowers as a function of this varying weight. With this variable position of the vehicle the position of the coupling clamp integral with the transportation vehicle obviously varies also and hence the position of the clamp in relation to the cable to which it is to be coupled varies. As mentioned above, accurate coupling position between the cable and the clamp jaw is therefore not assured.

A problem of this kind can however appear even when because of different loads acting on the cable the latter could be subject to vibrations and hence undulations with chatter especially between the guide rollers in the station in the zone where the clamp and cable should couple. This cable chatter too prejudices coupling which is safe or at least without forcing of the clamp on the cable.

SUMMARY OF THE INVENTION

The general purpose of the present invention is to remedy the problem of phase displacement of the clamp position in relation to the cable due to displacement of the vehicle or even phase displacements of the cable in relation to the clamp due to cable chatter between two guide rollers supported fixedly and to propose a cable traction haulage system which would at all times ensure the highest accuracy in positioning the transportation vehicle clamp for perfect cable coupling regardless of variations in the mutually relative positions of the transportation vehicle and the traction cable.

Another purpose is to propose a system in which it would be possible to effectively control the limit positions of the transportation vehicle in relation to the coupling rails, of the haulage cable in relation to the clamp, and of the haulage cable in relation to the fixed structure.

These and other purposes are achieved by a cable traction haulage system with the features indicated in the characterizing part of claim 1.

By providing an elastically supported coupling rail it is possible to allow for the relative displacements of the vehicle in relation to the rails along which the transportation vehicles run and by associating with the coupling rail a sprung roller bearing the traction cable, vibrations or chatter of the traction cable are absorbed.

Preferably the coupling rail is equipped respectively with a first support before the rise, i.e. maximum opening of the clamp, and a support after the maximum rise, coupling rail with each support consisting of a support to which is articulated one end of a rocker arm whose other end is articulated with the rail and is engaged with one end of a compression spring acting elastically with the other end on the rail.

Appropriately the rail has an end of travel sensor designed to operate when the moving spring jaw operating lever wheel goes beyond a predetermined limit position.

Other characteristics and details are explained in the following description of a preferred embodiment shown in the FIGS of the annexed drawing showing the following.

BRIEF DESCRIPTION OF THE DRAWINGS

In FIGS. 1 to 3 reference number 1 designates a coupling rail designed to be engaged by a wheel 2 (FIG. 3) borne in a rotating manner by the end of the operating lever of a movable jaw 6 of a disengageable coupling clamp 5 of known type and whose semifixed jaw 4 is designed to embrace with the movable jaw 6 a continuously moving haulage cable 7. The clamp 5 is elastically loaded in closed and open position around a dead axis or pin in a manner not further explained and is fastened to a structure designated as a whole by reference number 8 forming an integral part of a transportation vehicle (not shown) for example a cableway carriage constrained to a track.

Figure 1:
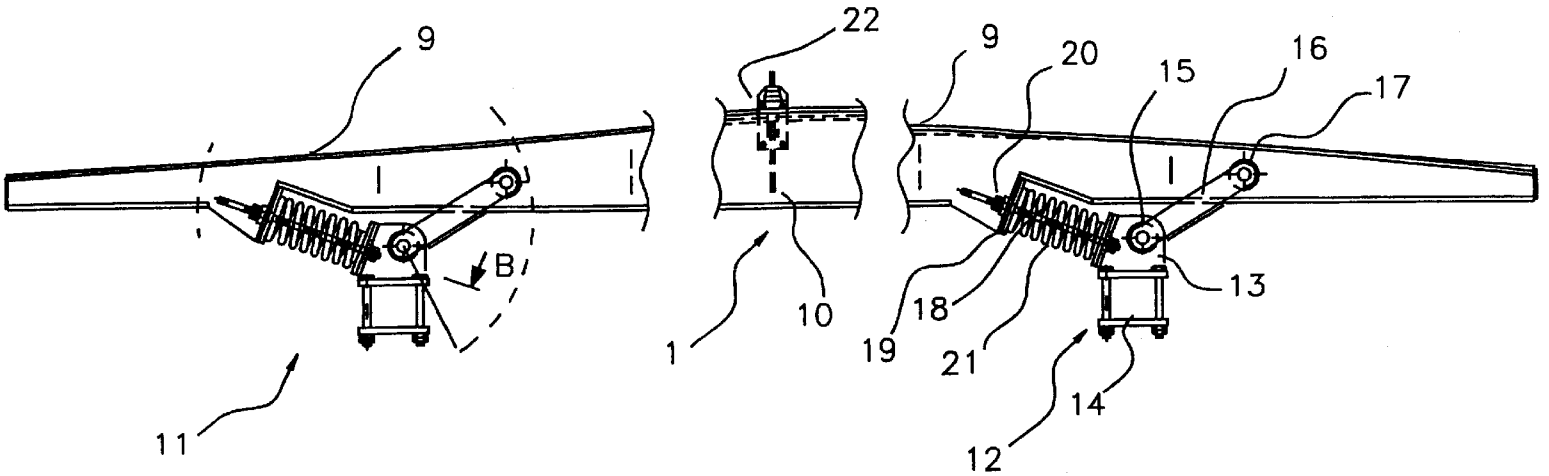
FIG. 1 shows in a partially sectioned plane of an elevation view perpendicular to the cable running direction a coupling rail for a desengageable coupling clamp of a transportation system.
Figure 2:
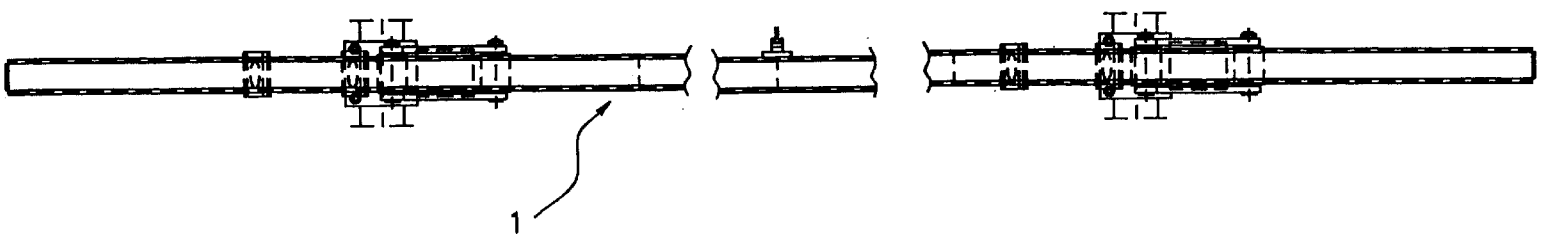
FIG. 2 shows a top view of FIG. 1.
Figure 3:
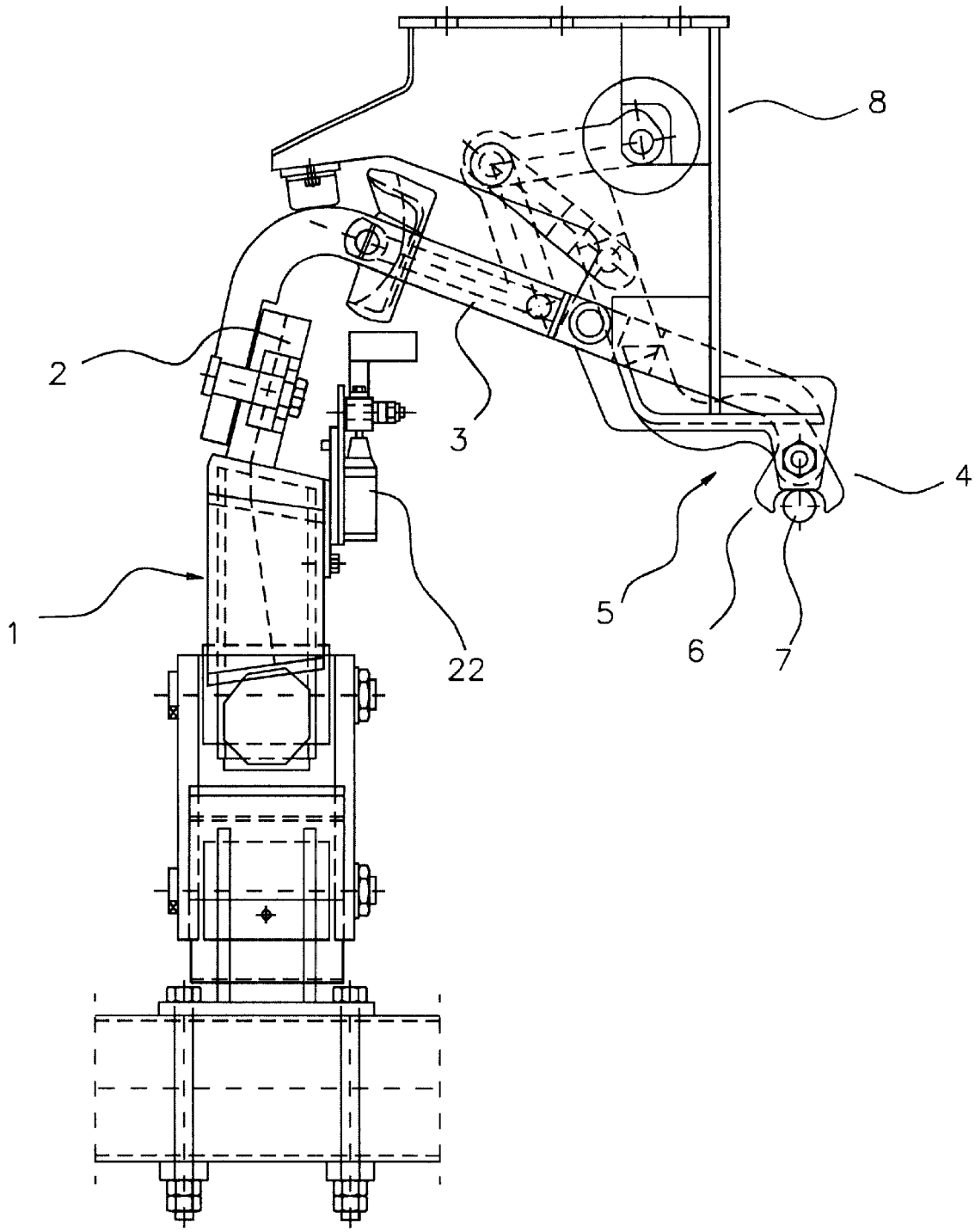
FIG. 3 shows a front view of FIG. 1 with associated coupling clamp.
Figure 4:
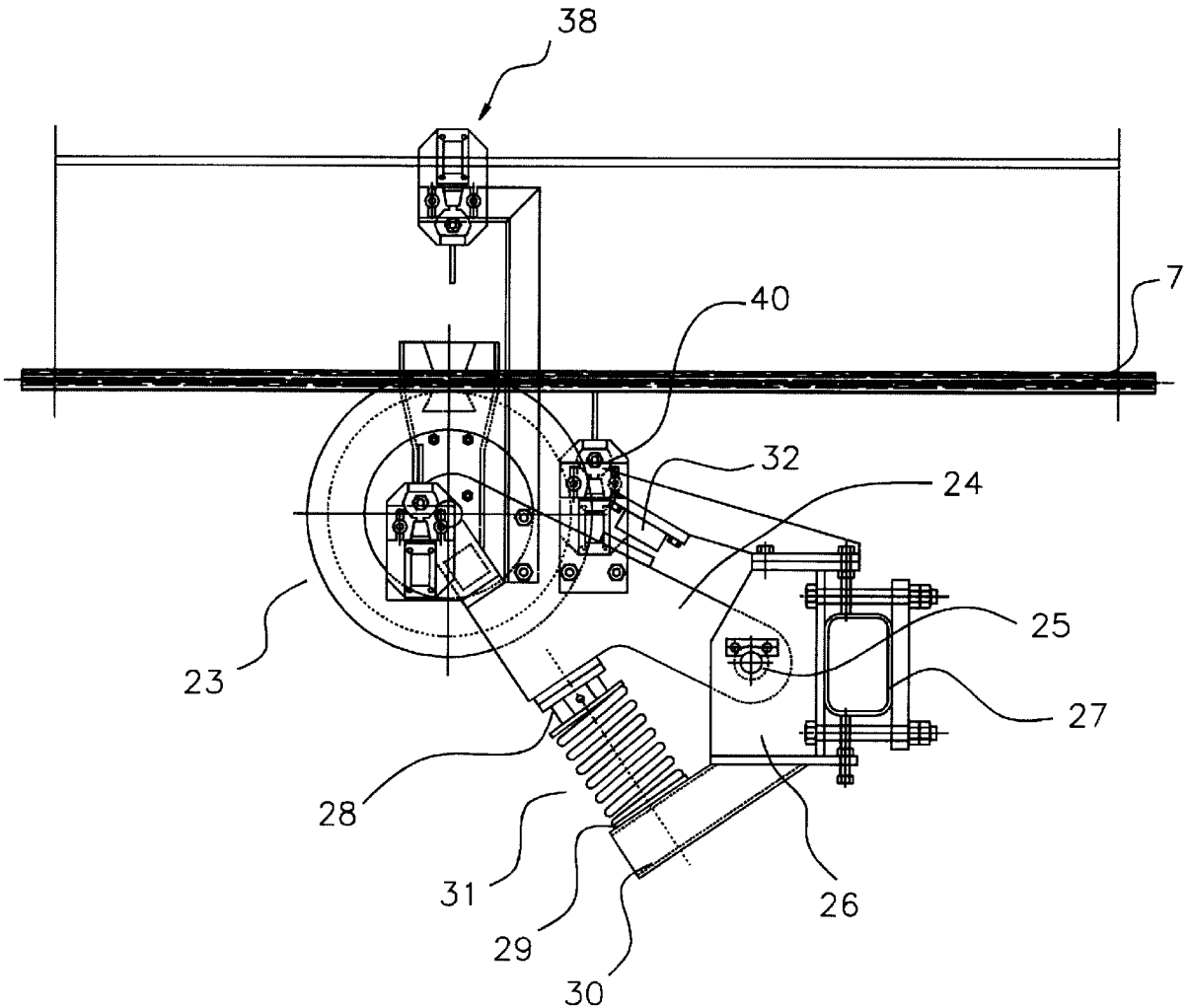
FIG. 4 shows in an elevation view in a direction perpendicular to the cable running direction an elastically supported roller in accordance with the present invention.
Figure 5:
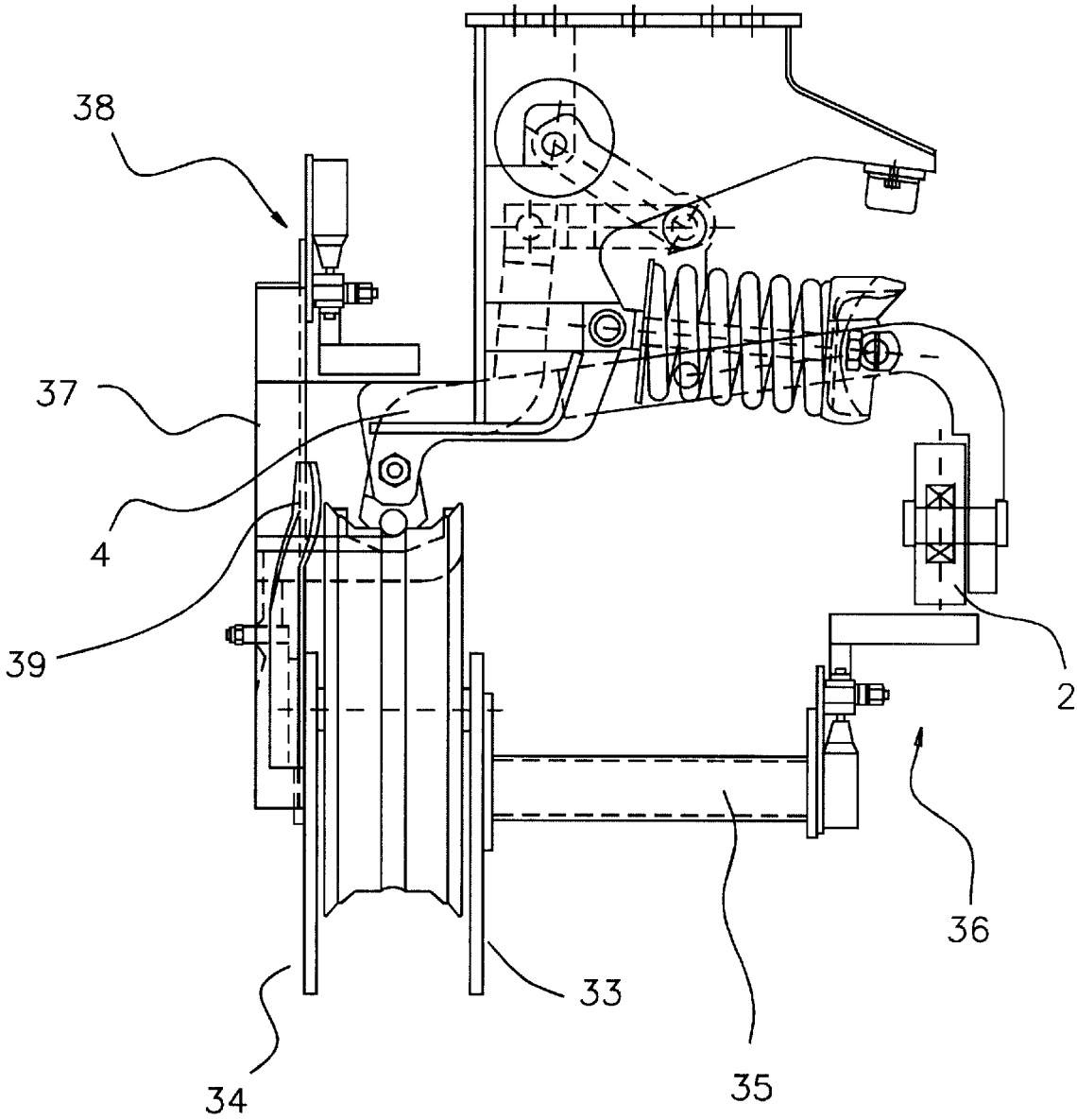
FIG. 5 shows a front view of FIG. 4.
Figure 6:
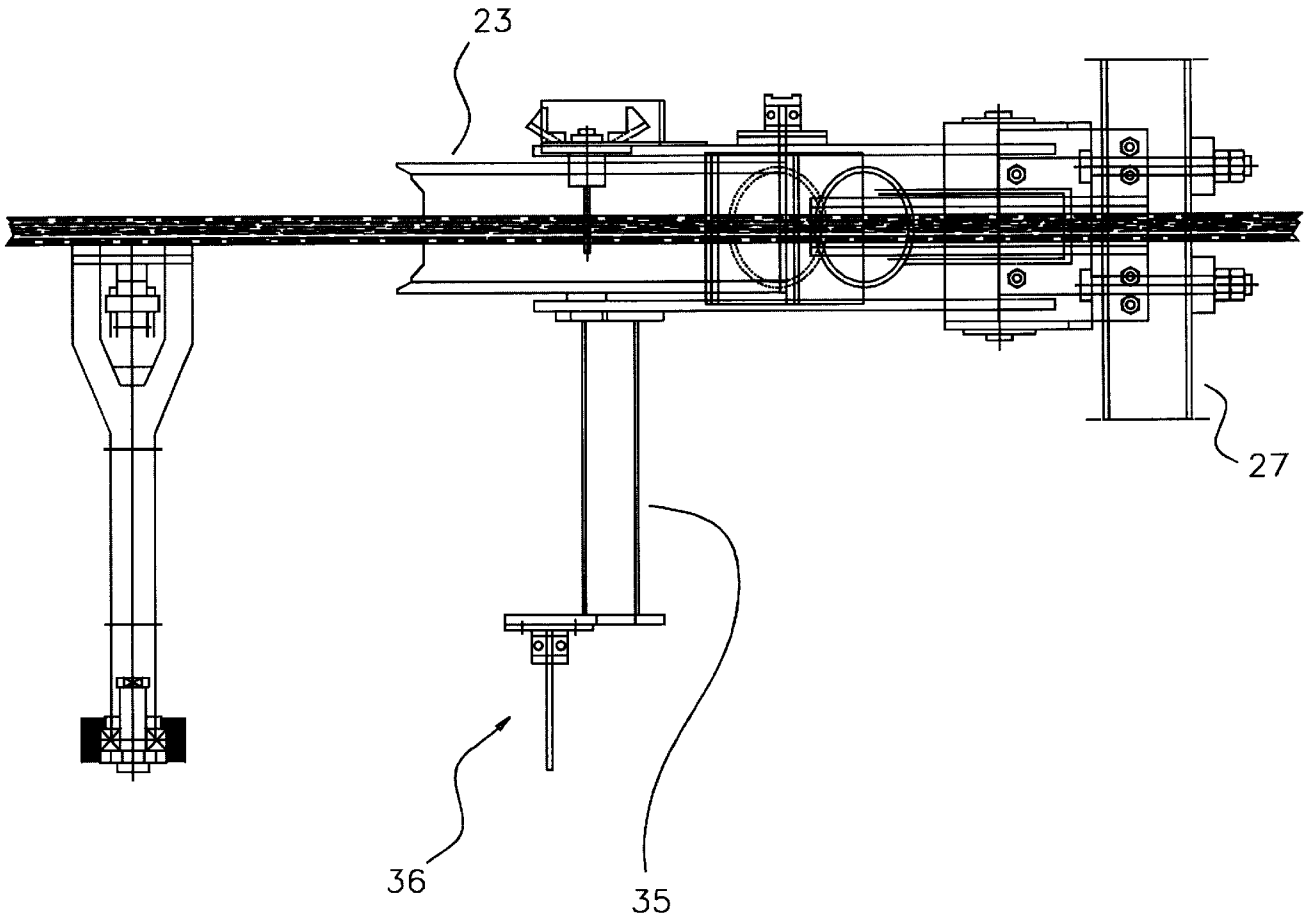
FIG. 6 shows a top view of FIG. 5.

The rail 1 displays a surface 9 inclined symmetrically in relation to a vertical trace plane 10 perpendicular to the traction cable 7.

To compensate for the vertical displacements of the clamp 5 due for example to displacement of the transportation vehicle under different weights, the rail 1 is supported elastically by two elastic supports 11 and 12 arranged respectively at equal distances from the plane of symmetry and identical so that only the construction of a single support will be explained below.

Each support 11, 12 displays a bracket 13 which is fastened below to a fixed beam 14. With the bracket 13 is articulated by means of a pin 15 one of the ends of an arm 16 whose other end is articulated with a rocker arm by means of a pin 17 with the rail 1 spaced by a vertical plane passing through the axis of the pin 15. From the side opposite the pin 17 in relation to the vertical plane passing through the axis of the pin 15 the end of a tie rod 18 with axis inclined upward in a spreading manner in relation to the arm 16 is fastened to the bracket 13. The tie rod 18 traverses with its other end a plate 19 with play and is screwed into a nut 20 which strikes against the plate 19 on the side opposite the side turned towards the bracket 13. The nut 20 is loaded on the plate 19 by a coil spring 21 compressed by the plate 19 and the bracket 13.

Appropriately the rail 1 has a limit switch 22 designed to detect an incorrect position of the lever 3 and transmit a signal to the command and control system.

With the coupling rail 1 is associated a roller 23 born in a rotating manner by a rocker arm 24 articulated by means of a pin 25 to a bracket 26 in turn permanently fastened to a beam 27 i.e. a fixed structure.

The rocker arm 24 displays a surface plate 28 perpendicular to an axis passing through the center of rotation of the roller 23 and forming an angle with a line passing through the centers of rotation of the roller 23 and the rocker arm 24.

A helical spring 31 loaded so as to push the roller 23 onto the cable 7 born by it is aranged between a surface plate 28 and a surface plate 29 virtually parallel thereto of a bearing 30 integral with the bracket 26.

From the bracket 26 extends above the rocker arm 24 on the side opposite the line of action of the spring 31 fixedly to striker 32 arranged in such a manner as to limit the oscillations of the rocker arm 24 around the pin 25 owing to the load on the spring 31. The rocker arm 24 displays two parallel plates 33 and 34 embracing the roller 23.

From the plate 33 turned towards the wheel 2 projects a permanently cantilevered section 35 bearing a limit switch 36 designed to operate if the wheel 2 goes beyond a minimum distance from the switch 36. To the plate 34 is fastened a riser 37 extending upward and bearing a switch 38 designed to operate when the movable jaw 4 is not in the correct position.

To the plate 34 is also permanently fastened an antifleet member 39 designed to prevent the cable 7 from jumping out of the groove of the roller 23.

A limit switch 40 is also provided to verify the correct limit position of the cable 7.

What is claimed is:

1. Continuously moving cable traction transportation system with vehicles equipped with coupling clamps disengageable from a cable comprising in one or more stations an uncoupling rail and a coupling rail for the clamps with the coupling rail characterized in that the coupling rail (1) is supported in a sprung manner and therewith is associated a sprung roller (23) bearing a haulage cable (7) between two fixed guide rollers.

2. System in accordance with claim 1 characterized in that symmetrically with the maximum rise the coupling rail (1) is borne by respectively a support (11, 12) consisting of a bracket (13) fastened to a fixed structure, a rocker arm (16) articulated with the bracket (13) and the coupling rail (1), and a spring (21) which is compressed between the bracket and the coupling rail and whose axis forms with the rocker arm axis an angle opening upward.

3. System in accordance with claim 2 characterized in that the coupling rail (1) is equipped with a limit switch (22) for an operating lever (3) of the coupling clamp (5).

4. System in accordance with claim 1 characterized in that the coupling rail (1) is equipped with a limit switch (22) for an operating lever (3) of the coupling clamp (5).

5. System in accordance with claim 4 characterized in that the rocker arm (24) is made up of two parallel plates (33, 34) holding between them in a rotating manner the sprung roller (23) with one (34) of the plates bearing externally a limit switch (38) of one of the jaws of the coupling clamp (4).

6. System in accordance with claim 5 characterized in that the other plate (33) bears a limit switch (38) for the wheel (2) of the operating lever.

7. System in accordance with claim 5 characterized in that the limit switch is fastened in an adjustable manner in its position.

8. System in accordance with claim 1 characterized in that the sprung roller (23) is borne by a rocker arm (24) articulated with a bracket (26) in turn permanently fastened to a fixed structure with the rocker arm (24) being elastically loaded by a spring (31) towards the cable (7) borne by the sprung roller (23).

* * * * *